US008757181B2

(12) United States Patent
Osaka et al.

(10) Patent No.: US 8,757,181 B2
(45) Date of Patent: Jun. 24, 2014

(54) SUBMERSIBLE CLEANING ROBOT

(75) Inventors: Takitarou Osaka, Osaka (JP); Junji Norita, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 1379 days.

(21) Appl. No.: 12/282,503

(22) PCT Filed: Mar. 14, 2006

(86) PCT No.: PCT/JP2006/304987

§ 371 (c)(1),
(2), (4) Date: Sep. 10, 2008

(87) PCT Pub. No.: WO2007/105303

PCT Pub. Date: Sep. 20, 2007

(65) Prior Publication Data

US 2009/0094765 A1 Apr. 16, 2009

(51) Int. Cl.
*B08B 3/02* (2006.01)

(52) U.S. Cl.
USPC ..... 134/176

(58) Field of Classification Search
USPC ..... 134/176
See application file for complete search history.

(56) References Cited

FOREIGN PATENT DOCUMENTS

| | | | | |
|---|---|---|---|---|
| JP | 51-92894 U | | 7/1976 | |
| JP | 56-139697 | * | 10/1981 | ..... B63H 1/26 |
| JP | 56-139697 U | | 10/1981 | |
| JP | 7-174297 | * | 11/1982 | |
| JP | 57-174297 U | | 11/1982 | |
| JP | 03-118291 | * | 5/1991 | ..... B63G 1/14 |
| JP | 03-118291 A | | 5/1991 | |
| JP | 04-074954 U | | 6/1992 | |
| JP | 08-26190 A | * | 1/1996 | ..... B63H 23/22 |
| JP | 08-107735 | * | 4/1996 | ..... A01K 75/00 |
| JP | 08-107735 A | | 4/1996 | |
| JP | 89-133186 A | | 5/1996 | |
| JP | 2001/-276754 | * | 10/2001 | ..... B08B 3/02 |
| JP | 2001-276754 A | | 10/2001 | |
| JP | 3592204 B2 | | 11/2004 | |

OTHER PUBLICATIONS

English Machine translation of JP08-26190A to Nomura.*
Notification of Reasons for Refusal for the Application No. 2008-504955 from Japan Patent office mailed Dec. 21, 2010.
International Search Report for the Application No. PCT/JP2006/304987 mailed Apr. 25, 2006.
Notification of Reasons for Refusal for the Application No. 2008-504955 from Japan Patent Office mailed May 11, 2010.

* cited by examiner

*Primary Examiner* — Michael Barr
*Assistant Examiner* — Jason Riggleman
(74) *Attorney, Agent, or Firm* — Cheng Law Group, PLLC

(57) ABSTRACT

A submersible cleaning robot cleaning a cleaning subject item by jetting high-pressure water from a cleaning nozzle unit towards a submerged cleaning subject item surface while moving along this cleaning subject item surface. The cleaning nozzle unit is mounted on a rotary shaft provided on a robot body so as to be capable of rotating freely and is configured to rotate in unison with this rotary shaft due to a reaction force of the jetting of high-pressure water at the cleaning subject item surface, and a propeller generating a propulsion force for urging the robot body towards the cleaning subject item surface by rotating pursuant to the rotation of the rotary shaft is provided on this rotary shaft. A front edge of each vane of the propeller in the direction of rotation thereof is formed so as to have a sweep-back angle preventing wrapping of foreign matter around the propeller.

5 Claims, 7 Drawing Sheets

SUBMERSIBLE CLEANING ROBOT

TECHNICAL FIELD

The present invention relates to a submersible cleaning robot performing cleaning of cleaning subject items such as farmed fish nets and ship hulls, etc. through jetting of high-pressure water.

BACKGROUND ART

Submersible cleaning robots for, for example, removing seaweed, algae, and shellfish, etc. having become attached to farmed fish nets and for removing dirt having become attached to ship hulls, etc. are known in the conventional technology (for example, see patent document 1).

Such a submersible cleaning robot cleans a cleaning subject item while moving along a submerged surface of the cleaning subject item by jetting high-pressure water from a cleaning nozzle unit towards this surface of the cleaning subject item. The cleaning nozzle unit is mounted on a rotary shaft provided on a robot body so as to be capable of rotation and rotates in unison with this rotary shaft due to a reaction force of the jetting of high-pressure water at the surface of the cleaning subject item.

Furthermore, a propeller generating a propulsion force for urging the robot body toward the surface of the cleaning subject item by rotating pursuant to a rotation of the rotary shaft is mounted on this rotary shaft.

Patent document 1: JP3592204

DISCLOSURE OF INVENTION

Problem to be Solved by the Invention

The above-described conventional submersible cleaning robot has a problem in that, as a front edge of a vane of the propeller in the rotation direction thereof has a radial shape, and in addition, is provided linearly, foreign matter such as seaweed and algae, etc. having become attached to farmed fish nets readily wraps around the propeller after having been removed by the cleaning nozzle unit. When foreign matter wraps around the propeller, it reduces a rotation force of the propeller, and therefore, the propulsion force for urging the robot body toward the surface of the cleaning subject item reduces and stable travel becomes difficult.

Furthermore, as a rotation speed of the cleaning nozzle unit also reduces, efficient jetting of high-pressure water within a prescribed range could become impossible.

It is an object of the present invention to make it difficult for foreign matter such as seaweed and algae, etc. to wrap around the propeller by optimizing a shape of the propeller.

Means for Solving Problem

The present invention resolves the above-explained problems as a submersible cleaning robot cleaning a cleaning subject item by jetting high-pressure water from a cleaning nozzle provided in a cleaning nozzle unit towards a submerged cleaning subject item surface while moving along this cleaning subject item surface, wherein the cleaning nozzle unit is mounted on a rotary shaft provided on a robot body so as to be capable of rotating freely and is configured so as to rotate in unison with this rotary shaft due to a reaction force of the jetting of high-pressure water at the cleaning subject item surface, a propeller generating a propulsion force for urging the robot body towards the cleaning subject item surface by rotating pursuant to the rotation of the rotary shaft is provided on this rotary shaft; and a front edge of each vane of the propeller in the direction of rotation thereof is formed so as to have a sweep-back angle preventing wrapping around of foreign matter.

It is preferable that the shape of the front edge having the sweep-back angle of the submersible cleaning robot of the present invention is formed from a base section of a vane to a tip thereof.

It is preferable that the rotary shaft of the submersible cleaning robot of the present invention is inserted into a support cylinder, and that a rotary shaft cover body covering an end section of the support cylinder is provided on the propeller.

The cleaning nozzle unit of the submersible cleaning robot of the present invention includes a disk-shaped rotary body, the cleaning nozzle is mounted on the rotary body, and a contact preventing body is provided at a position on the rotary body in front of the cleaning nozzle.

Effect of the Invention

The present invention can make it difficult for foreign matter such as seaweed and algae, etc. to wrap around the propeller during cleaning and is capable of stable and efficient cleaning of the cleaning subject item.

DESCRIPTION OF REFERENCE NUMERALS

Figure 1:
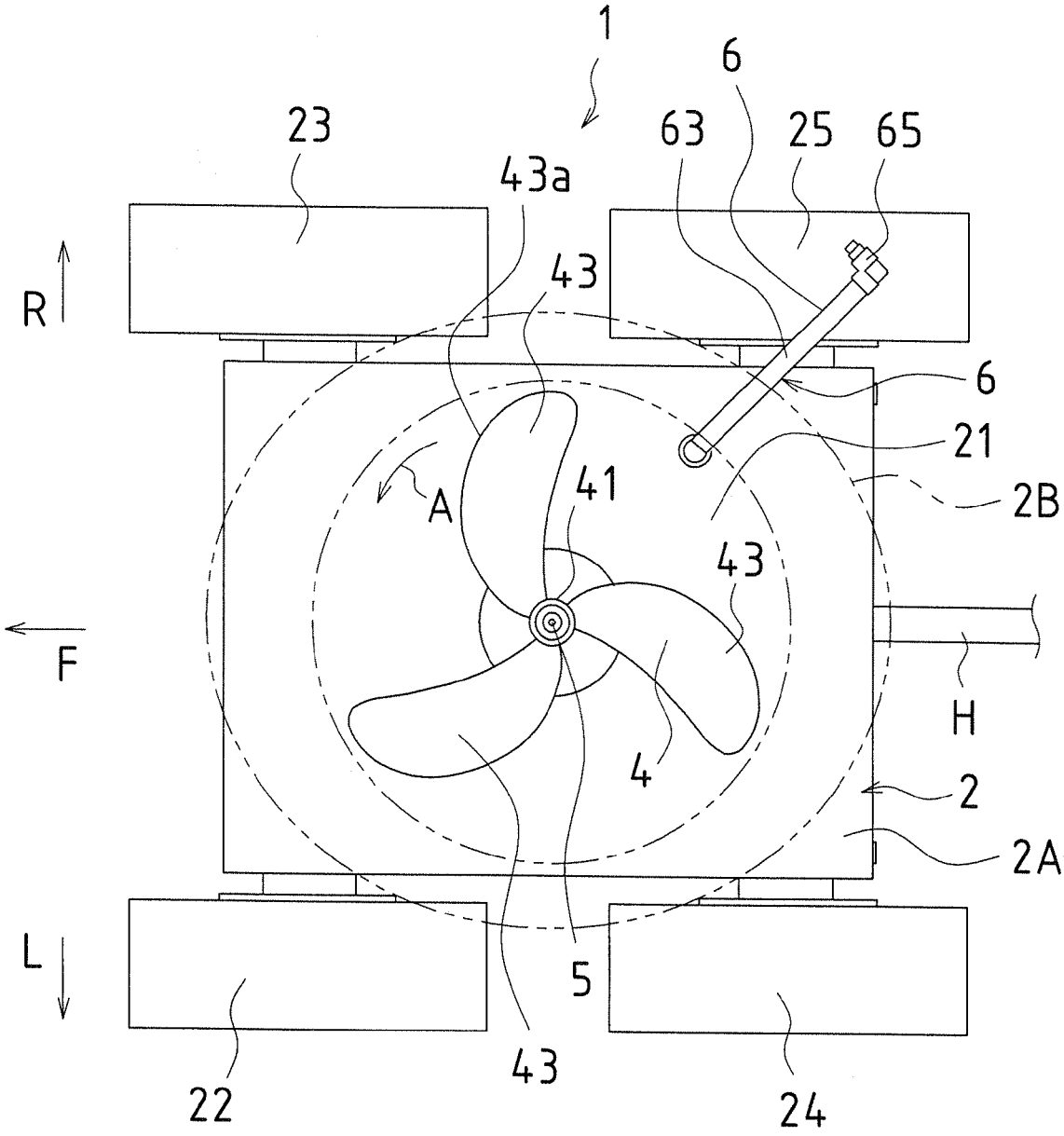
FIG. 1: A plan view of a submersible cleaning robot according to an embodiment of the present invention.

1. Submersible cleaning robot
2. Robot body
3. Cleaning nozzle unit
4. Propeller (propulsion-force generating propeller)
5. Rotary shaft
11. Support cylinder
35. Rotation body
41. Central section
43. Vane
45. Rotary shaft cover body
θ. Sweep-back angle

BEST MODE FOR CARRYING OUT THE INVENTION

Hereinafter, an embodiment of the present invention is explained based on the drawings.

For the purpose of this embodiment, a case of application of the present invention as a self-propelled submersible cleaning robot for performing cleaning of a farmed fish net is explained.

—Explanation of a Configuration of the Submersible Cleaning Robot—

Figure 2:
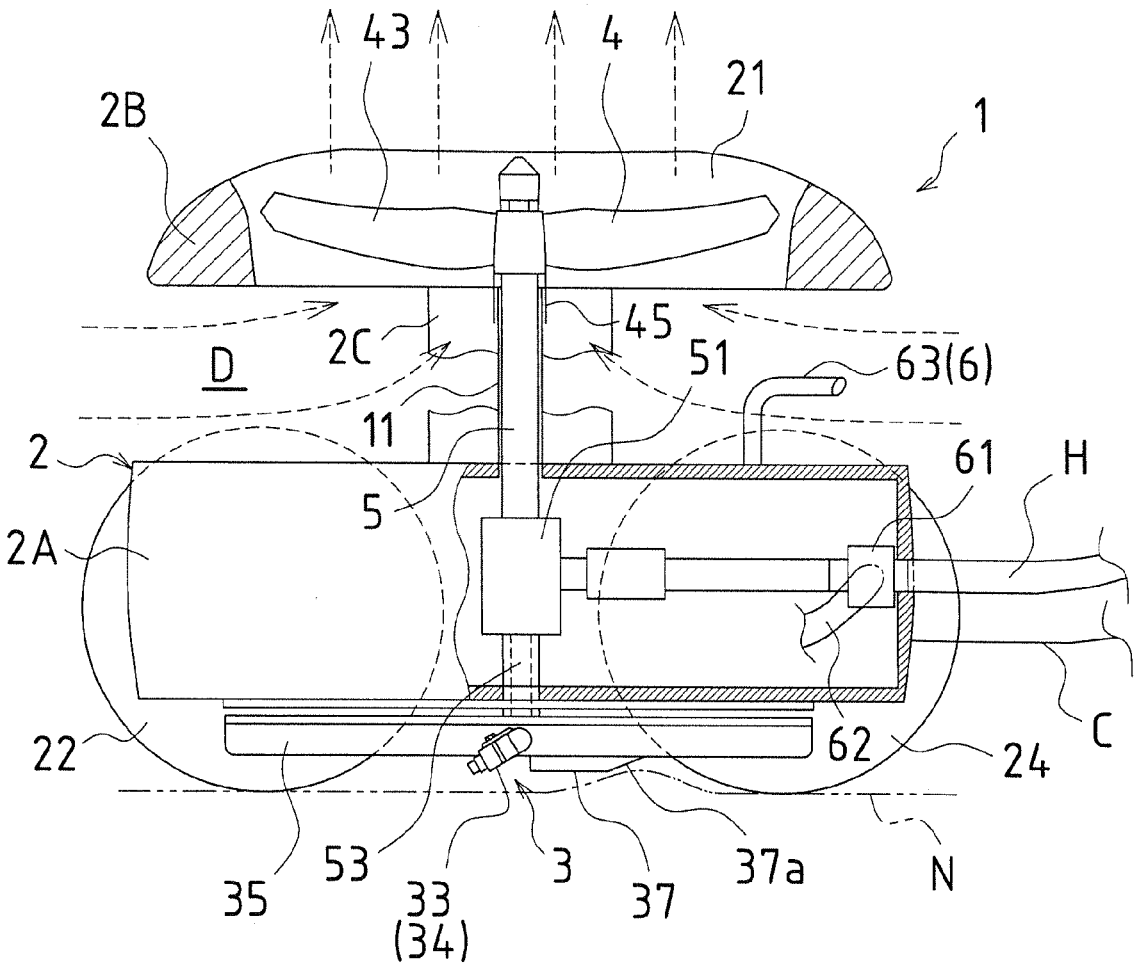
FIG. 2: A side view including a partial cross-section of the submersible cleaning robot in FIG. 1.
Figure 3:
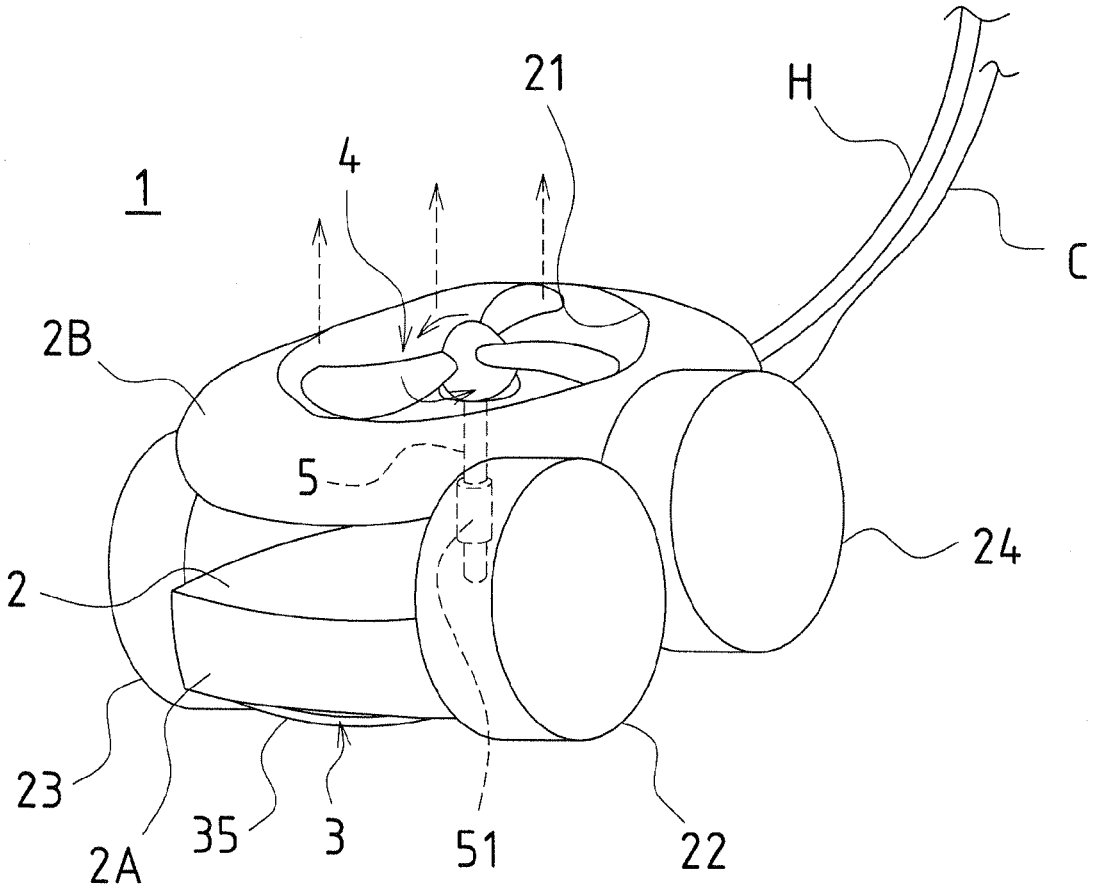
FIG. 3: A perspective view of the submersible cleaning robot in FIG. 1.

FIGS. 1 to 7 show a submersible cleaning robot 1 according to this embodiment. The submersible cleaning robot 1 according to this embodiment includes, as shown in FIGS. 1 to 3, a robot body 2, a cleaning nozzle unit 3, and a propulsion-force generating propeller 4 (hereinafter, simply referred to as the "propeller").

The robot body 2 includes a lower nozzle side body 2A, an upper propeller side body 2B, and a pair of planar connecting bodies 2C, 2D connecting these bodies together. The propeller side body 2B is disposed such that a prescribed distance exists between the propeller side body 2B and the nozzle side body 2A, and an entrance space D functioning as an entrance channel for water is formed in this gap between the propeller side body 2B and the nozzle side body 2A.

An opening 21 of a relatively large diameter is formed at a central part of the propeller side body 2B, and the propeller 4 is housed in an interior of this opening 21. That is to say, the configuration is such that water is introduced from the entrance space D towards this propeller 4 due to a rotation of the propeller 4.

On left and right side surfaces of the nozzle side body 2A, 4 wheels (front, rear, left, and right wheels) 22, 23, 24, 25 are mounted so as to be capable of rotation. In FIG. 1, a direction shown by an arrow F shows a forward direction of the submersible cleaning robot 1. Furthermore, an arrow R shows a right side when facing in the forward direction of the submersible cleaning robot 1, and an arrow L shows a left side.

Figure 6:
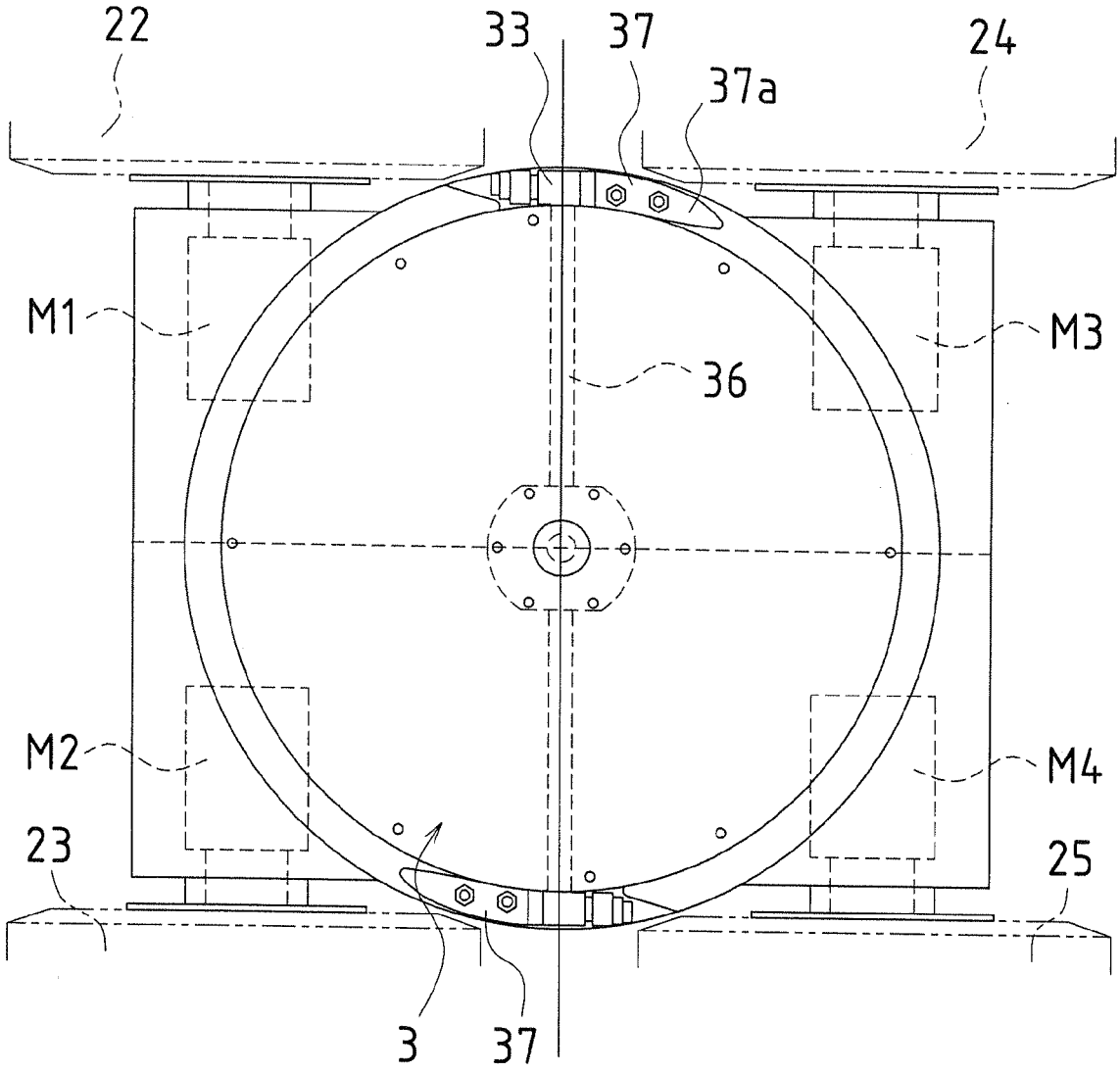
FIG. 6: A bottom view of a submersible cleaning robot according to an embodiment of the present invention.

As shown in FIG. 6, for example, 4 submersible motors M1, M2, M3, M4 are housed in the nozzle side body 2A, and a drive shaft of each of the submersible motors M1, M2, M3, M4 is connected to one of the wheels 22, 23, 24, 25, respectively.

A power supply cable C is connected to each of the submersible motors M1, M2, M3, M4. When the submersible cleaning robot 1 has been submerged in water, the power supply cable C extends from a power-supply device, not shown in the figures, on land or on a boat to the submersible cleaning robot 1 and performs supply of power to each of the submersible motors M1, M2, M3, M4. As a result of this, each of the wheels 22 to 25 rotates pursuant to driving of these submersible motors M1, M2, M3, M4.

If, for example, when the submersible cleaning robot 1 is in a state of forward travel (travel in the direction of the arrow F of FIG. 1), a rotation speed of the right-side submersible motors M2, M4 is set higher than a rotation speed of the left-side submersible motors M1, M3, the travel direction of the submersible cleaning robot 1 will change to face the left direction of FIG. 1 (the direction of the arrow L). Conversely, if the rotation speed of the left-side submersible motors M1, M3 is set higher than the rotation speed of the right-side submersible motors M2, M4, the travel direction of the submersible cleaning robot 1 will change to face the right direction of FIG. 1 (the direction of the arrow R).

Even in a case wherein the submersible cleaning robot 1 is driven in reverse by rotating the submersible motors M1, M2, M3, M4 in an opposite direction to that mentioned above, it is possible to change a direction of travel in the same way. In addition, if the submersible motors M1, M3 and the submersible motors M2, M4 are rotated in mutually opposite directions, the submersible cleaning robot 1 can be rotated.

In terms of submersible motors, it should be noted that 2 submersible motors M1, M2 may be provided so as to drive in rotation the left and right front wheels 22, 23, and the left-side front and rear wheels 22, 24 and the right-side front and right rear wheels 23, 25 may be mechanically connected using a belt construction or a chain construction.

The cleaning nozzle unit 3 is an item that jets high-pressure water supplied from a high-pressure water hose H explained hereinafter towards the farmed fish net as a cleaning subject item, and through that jetting, cleans the farmed fish net. As shown in FIG. 2, the cleaning nozzle unit 3 is mounted on a bottom section of a rotary shaft 5 inserted into a support cylinder 11 secured in a vertical upward direction from the nozzle side body 2A. This rotary shaft 5 is supported so as to be capable of rotating freely by a rotary joint 51 such that the rotary shaft 5 is disposed at a central part of the above-explained opening 21 formed in the propeller side body 2B.

An end of the high-pressure water hose H is connected to the rotary joint 51. Another end of the high-pressure water hose H is connected to a high-pressure pump, not shown in the figures, on land or on a boat, and high-pressure water pressure fed from this high-pressure pump is supplied to the cleaning nozzle unit 3. It should be noted that a high-pressure water channel 53 is formed inside the rotary shaft 5 in order to send high-pressure water supplied from the high-pressure water hose H via the rotary joint 51 to the cleaning nozzle unit 3.

Figure 7:
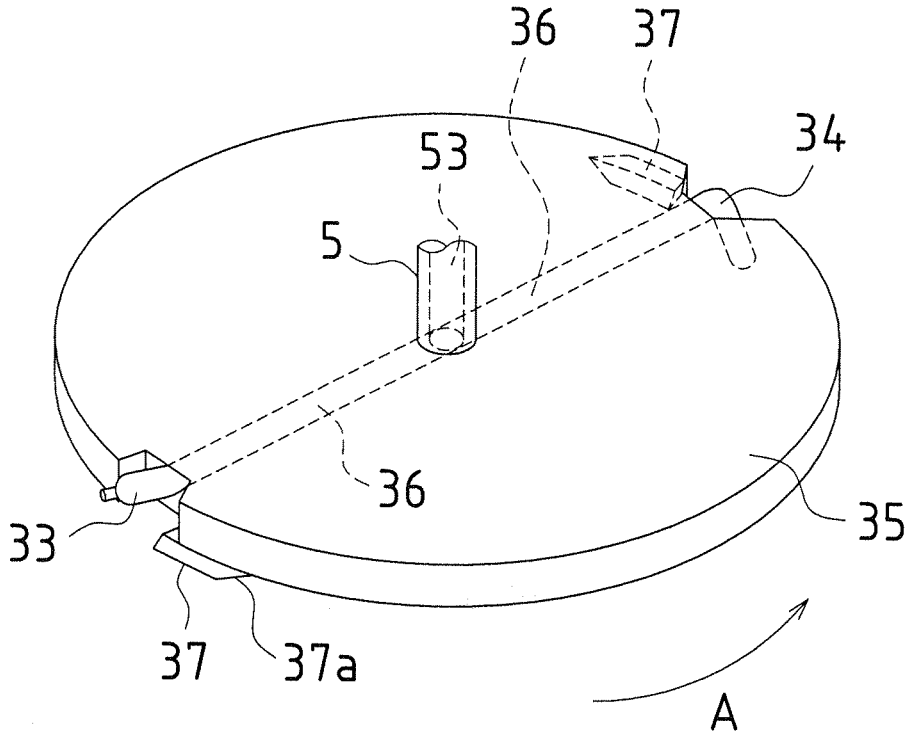
FIG. 7: A perspective view of a cleaning nozzle.

The cleaning nozzle unit 3 includes a disk-shaped rotary body 35 secured to a bottom edge of the above-explained rotary shaft 5, and inside this rotary body 35, as shown in FIG. 7, a jetting channel 36 for high-pressure water is formed communicating with the high-pressure water channel 53 of the above-explained rotary shaft 5, and in addition, in a radial direction of the rotary body 35. A plurality (a pair in this embodiment) of cleaning nozzles 33, 34 communicating with the jetting channel 36 are mounted on an outer peripheral section of the rotary body 35.

These cleaning nozzles 33, 34 are inclined downward at a prescribed angle in order to orient the jetting direction of the high-pressure water towards a surface of the farmed fish net. In specific terms, as shown in FIG. 7, an orientation of each of the cleaning nozzles 33, 34 is such that the rotary body 35 is rotated in a direction of an arrow A, and in addition, that the cleaning nozzles 33, 34 are inclined downward towards a surface of the farmed fish net (inclined downwards in the figure) at a prescribed angle (for example, 5 to 45°).

As a result of this, in a case wherein high-pressure water is jetted from the cleaning nozzles 33, 34, the cleaning nozzle unit 3 will rotate together with the rotary shaft 5 due to a jetting reaction force generated pursuant to the jetting of this high-pressure water at a surface of the farmed fish net. In other words, this cleaning nozzle unit 3 is configured so as to be capable of removing algae and shellfish, etc. having become attached to the farmed fish net over a wide range by jetting high-pressure water at the surface of the farmed fish net while rotating about an axis of the rotary shaft 5.

Although it is preferable that each cleaning nozzle 33, 34 performs jetting in close proximity to the surface of the farmed fish net, if the cleaning nozzles 33, 34 are in excessively close proximity, contact with the surface of the farmed fish net becomes more likely. Accordingly, a contact prevention body 37 is secured to a bottom surface of the rotary body 35, and in addition, at a position in front of each of the cleaning nozzles 33, 34 (a position in an opposite direction to the orientation of each of the cleaning nozzles 33, 34). An upward-facing inclined surface 37*a* guiding the farmed fish net making contact is formed at a front section of this contact prevention body 37.

The above-explained propeller 4 is provided as one with the rotary shaft 5. The propeller 4 is housed inside the opening 21 formed in the propeller side body 2B and includes a central section 41 mounted as one with an upper edge of the above-explained rotary shaft 5 and a plurality (3) of vanes 43 provided at this central section 41.

Accordingly, in a case wherein high-pressure water is jetted from the cleaning nozzles 33, 34 and the rotary shaft 5 rotates together with the cleaning nozzle unit 3 as a result of the jetting reaction force thereof, this propeller 4 also rotates integrally (in the direction of the arrow A shown in FIG. 1), and a water flow urging the submersible cleaning robot 1 downwards will be generated. As a result of this, the configuration is such that a propulsion force urging the submersible cleaning robot 1 towards the farmed fish net is generated when performing a cleaning operation.

In this way, the submersible cleaning robot 1 according to this embodiment is configured such that the cleaning nozzle unit 3 and the propeller 4 rotate integrally using the rotary shaft 5, and due to a jetting reaction force upon the jetting of high-pressure water from the cleaning nozzles 33, 34, these three 3, 4, 5 are rotated and propulsion force is obtained due to rotation of the propeller 4.

Figure 4:
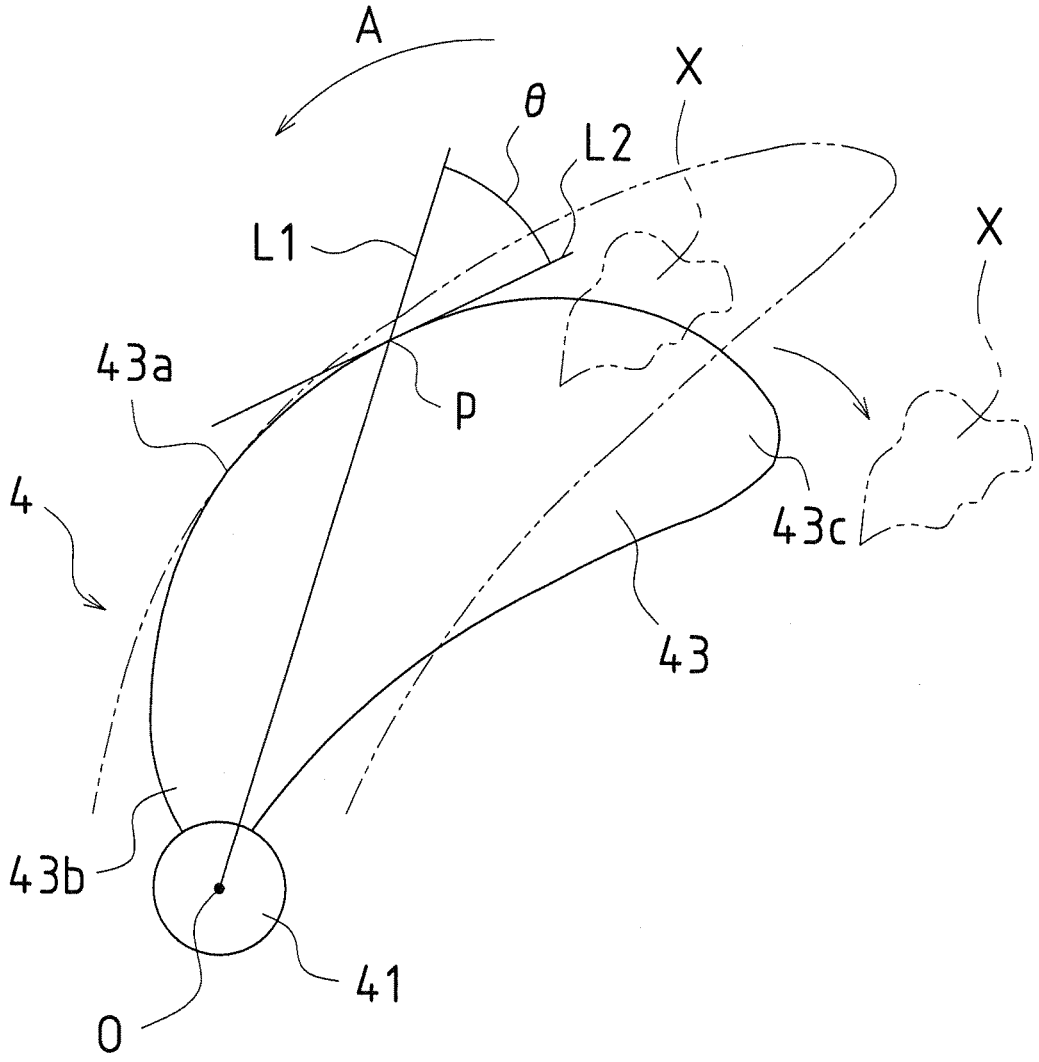
FIG. 4: A plan view showing a main part of a propeller used in the submersible cleaning robot in FIG. 1.

A front edge 43*a* of each of the vanes 43 of the propeller 4 in a rotation direction A thereof is formed curved having a sweep-back angle θ preventing wrapping around of foreign matter X as shown in FIG. 4. This sweep-back angle θ refers to an angle formed between a straight line L1 joining an arbitrary point P on the front edge 43*a* with a rotation center O of the propeller 4 and a tangent L2 of the front edge 43*a* at the point P. It is preferable that each of the vanes 43 has the sweep-back angle θ formed from a vicinity of a base section 43*b* at the central section 41 side to a tip 43*c*. The sweep-back angle θ is set so as to become gradually larger towards a tip of each vane 43. It should be noted that a developed shape of each of the vanes 43 is shown by a chain double-dashed line in FIG. 4.

Figure 5:
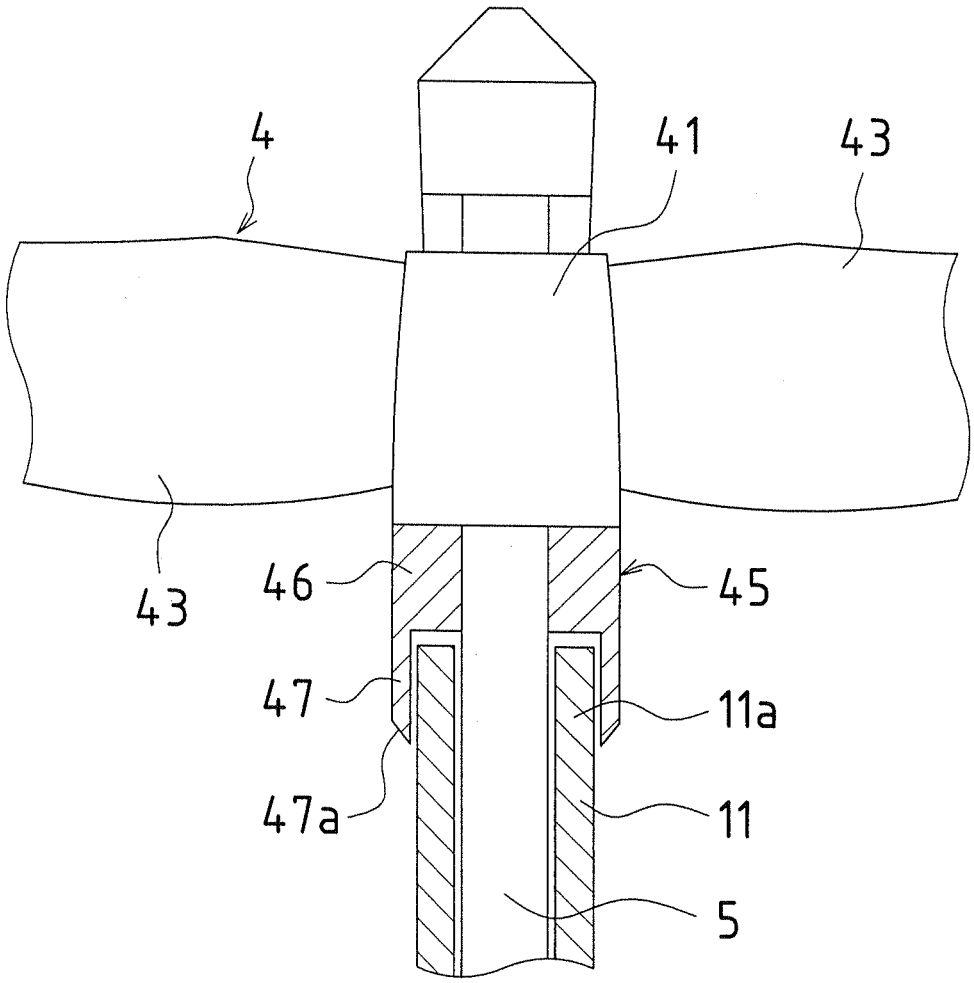
FIG. 5: A cross-sectional view showing a main part of a mounting construction of the propeller.

As shown in FIG. 5, a rotary shaft cover body 45 is mounted on a bottom surface of the central section 41 of the propeller 4. This rotary shaft cover body 45 includes a mounting member 46 and a cylindrical member 47 formed as one with this mounting member 46 and having an open bottom surface. The rotary shaft cover body 45 covers a gap between an upper end section (end section) 11*a* of the support cylinder 11 and the central section 41 of the propeller 4 and prevents foreign matter from wrapping around the rotary shaft 5 between the support cylinder 11 and the propeller 4. Furthermore, a taper surface 47*a* is formed on a bottom surface of the cylindrical member 47. By providing the taper surface 47*a*, foreign material making contact with the rotary shaft cover body 45 can be efficiently removed.

The submersible cleaning robot 1 is provided with an auxiliary nozzle unit 6 in order to prevent drag around from occurring in the robot body 2 due to rotation of the rotary shaft 5. That is to say, as the robot body 2 also tends to rotate in the direction of rotation of the rotary shaft 5 due to sliding resistance, etc. between the above-explained rotary shaft 5 and the rotary joint 51 upon rotation of the cleaning nozzle unit 3 and the rotary shaft 5, the purpose of the auxiliary nozzle unit 6 is to cancel out that force.

This auxiliary nozzle unit 6 includes a junction hose 62 connected to a junction joint 61 mounted inside the nozzle side body 2A, an arm 63 connected to this junction hose 62 and secured to the nozzle side body 2A, and an auxiliary nozzle 65 mounted on a tip of this arm 63. A high-pressure water jetting direction of an auxiliary nozzles 65 is oriented in a direction preventing rotation of the robot body 2 (a direction of rotation of the propeller 4 in a case wherein the robot body 2 is dragged around).

—Explanation of an Operation of the Submersible Cleaning Robot 1—

Hereinafter, a cleaning operation of a farmed fish net using the submersible cleaning robot 1 of a configuration as explained above is explained. Upon this cleaning, the submersible cleaning robot 1 is submerged from land or a boat to an inner side (fish farming space) of a farmed fish net N as shown in FIG. 1. In addition, electrical power is supplied to each submersible motor from the power supply cable C and high-pressure water is supplied to the cleaning nozzle unit 3 and the auxiliary nozzle unit 6 from the high-pressure water hose H.

As a result of this, each of the submersible motors M1, M2, M3, M4 drives and the submersible cleaning robot 1 travels along the farmed fish net N due to rotation of each of the wheels 22 to 25.

Furthermore, jetting of high-pressure water from each of the cleaning nozzles 33, 34 of the cleaning nozzle unit 3 and from the auxiliary nozzle 65 of the auxiliary nozzle unit 6 is carried out. As a result of the jetting of high-pressure water from the cleaning nozzles 33, 34, algae and shellfish, etc. having become attached to the farmed fish net N are removed and discharged outside the fish farming space, and the farmed fish net N is cleaned.

The cleaning nozzle unit 3, the rotary shaft 5, and the propeller 4 rotate in unison as a result of the jetting reaction force pursuant to this jetting of high-pressure water. As shown by a dashed-line arrow in FIG. 2, water is introduced towards the propeller 4 from the entrance space D due to this rotation of the propeller 4 and a water flow discharged from the opening 21 is generated, and as a result of this, a propulsion force is obtained at the submersible cleaning robot 1 and a condition in which each of the wheels 22 to 25 contacts with the farmed fish net N at a prescribed pressure is maintained.

For this reason, there is no lifting up of each of the wheels 22 to 25 from the farmed fish net N, and the submersible cleaning robot 1 performs cleaning of the farmed fish net N while traveling stably along the farmed fish net N.

Upon cleaning of the farmed fish net N, a water flow of high-pressure water jetted from the cleaning nozzles 33, 34 of the cleaning nozzle unit 3 to remove algae and shellfish, etc. and a water flow flowing in the vicinity of the propeller 4 to obtain the propulsion force can be cut off using the nozzle side body 2A, and there is almost no moving around of algae and shellfish, etc. separated and removed from the farmed fish net N to an entrance side of the propeller 4.

In cases of cleaning of especially dirty farmed fish nets N in particular, there are cases wherein removed matter such as algae, etc. flows into the entrance space D of the submersible cleaning robot 1. Furthermore, there are also cases wherein, other than the removed matter, rope, etc. and other foreign matter used in farmed fish nets N flows into the entrance space D of the submersible cleaning robot 1. If the foreign matter (including the removed matter) flows around to the entrance side of the propeller 4, it will make contact with the propeller 4; however, as the front edge 43*a* in the direction of rotation of each of the vanes 43 of the propeller 4 is formed so as to have the sweep-back angle θ, the foreign matter X readily slides on this front edge 43*a* without wrapping around the front edge 43*a* and moves away from the rotating propeller 4. Furthermore, as the rotary shaft cover body 45 is provided at the bottom section of the propeller 4, the foreign matter X does not wrap around the rotary shaft 5.

Furthermore, although the cleaning nozzles 33, 34 and the rotary body 35 rotate together, the contact prevention body 37 is disposed in front of the cleaning nozzles 33, 34, and therefore, this contact prevention body 37 guides the farmed fish net N that draws close so as not to make contact with the cleaning nozzles 33, 34.

As a result, it is possible to avoid trouble in the form of cleaning operations being adversely affected due to, for example, the removed matter, etc. and other foreign matter X having been removed from the farmed fish net N wrapping around the propeller 4 or the cleaning nozzles 33, 34 making unintentional contact with the farmed fish net N, and it is possible to also avoid the occurrence of a condition giving rise to damage to the submersible cleaning robot 1.

In this embodiment, as explained above, in addition to causing the cleaning nozzle unit 3 to rotate using the jetting reaction force occurring upon the jetting of high-pressure water towards the farmed fish net N, the propeller 4 is caused to rotate using this rotation force. Furthermore, although a propulsion force is obtained at the submersible cleaning robot 1 as a result of this rotation of the propeller 4, the front edge 43*a* of each of the vanes 43 of the propeller 4 is formed curved so as to have the sweep-back angle θ preventing wrapping around of the foreign material X, and therefore, reduction of the rotation force of the propeller 4 due to foreign matter can be prevented.

Furthermore, as the contact prevention body 37 provided in front of the cleaning nozzles 33, 34 guides the farmed fish net N so as not to make contact with the cleaning nozzles 33, 34, reduction of the rotation force of the propeller 4 can be prevented. As a result of this, due to a synergistic effect of a shape of the propeller 4 and the contact prevention body 37, a prescribed propulsion force can be maintained with the propeller 4, and stable cleaning operations can be carried out.

The present invention is not limited to the above-explained embodiment. For example, in the above-explained embodiment, a case of application of the present invention to a self-propelled submersible cleaning robot for performing cleaning of a farmed fish net N is explained. The present invention is not limited thereto, and application to a suspended-type submersible cleaning robot (an item performing cleaning in a condition of suspension from a ship hull, etc. by a wire rope) is also possible. Furthermore, the cleaning subject item is not limited to the farmed fish net N, and usage is also possible in the cleaning of bridge legs, ship hulls, and pools, etc.

Furthermore, in the above-explained embodiment, one each of the cleaning nozzle unit 3, propeller 4, and rotary shaft 5 is provided; however, a plurality of units each combining these three 3, 4, 5 as one assembly can be provided. In particular, if any even number of these units is provided and the number of units rotating in one direction is the same as the number of units rotating in the opposite direction thereto, a rotation reaction force occurring in the robot body 2 due to sliding resistance between the rotary shaft 5 and the rotary joint 51 can be cancelled out. As a result of this, it is possible to eliminate the need for the auxiliary nozzle unit 6.

The robot body 2 does not need to be separated into the nozzle side body 2A and the propeller side body 2B, and the entrance space D can be formed in the robot body 2 by opening a portion thereof.

INDUSTRIAL APPLICABILITY

With the present invention as explained above, upon the cleaning of cleaning subject items such as farmed fish nets and ship bodies, etc. using a submersible cleaning robot, the wrapping of foreign matter such as removed matter, etc. around a propeller for generating a force of propulsion can be prevented and stable cleaning operations can be carried out efficiently.

The invention claimed is:

1. A submersible cleaning robot cleaning a cleaning subject item by jetting high-pressure water from a cleaning nozzle provided in a cleaning nozzle unit towards a submerged cleaning subject item surface while moving along this cleaning subject item surface, wherein the cleaning nozzle unit is mounted on a lower portion of a rotary shaft provided on a robot body so as to be capable of rotating freely and is configured so as to rotate in unison with this rotary shaft due to a reaction force of the jetting of high-pressure water at the cleaning subject item surface;

a propeller generating a propulsion force for urging the robot body towards the cleaning subject item surface by rotating pursuant to the rotation of the rotary shall is provided on an upper portion of this rotary shaft;

a front edge of each vane of the propeller in the direction of rotation thereof is formed so as to have a sweep-back angle preventing wrapping around of foreign matter;

sweep-back angles along an entirety of an edge of the propeller vane from the rotary shaft to a tip of the vane gradually increase toward the tip of the vane;

the rotary shaft is inserted into a support cylinder fixed to the robot body;

a rotary shaft cover body including a mounting member and a cylindrical member is mounted on a lower surface of a central section of the propeller, the mounting member is disposed between the lower surface of the central section of the propeller and an end section of the support cylinder such that the rotary shaft is inserted into the mounting member, and the cylindrical member is integrally formed with the mounting member so as to cover an outer peripheral surface of the end section of the support cylinder; and the rotary shaft cover body covers a gap between the end section of the support cylinder and the lower surface of the central section of the propeller.

2. The submersible cleaning robot of claim 1, wherein a taper surface is formed on a bottom surface of the cylindrical member such that a diameter of the taper surface gradually becomes larger toward the propeller.

3. The submersible cleaning robot of claim 1, wherein an inner radius of the mounting member is smaller than an inner radius of the cylindrical member.

4. The submersible cleaning robot of claim 1, wherein the cleaning nozzle unit comprises a disk-shaped rotary body, the cleaning nozzle is mounted on the rotary body, and a contact preventing body is provided at a position on the rotary body in front of the cleaning nozzle in the rotation direction of the cleaning nozzle.

5. The submersible cleaning robot of claim 4, wherein a taper surface is formed on a bottom surface of the cylindrical member such that a diameter of the taper surface gradually becomes larger toward the propeller.

* * * * *